United States Patent [19]

Brown

[11] Patent Number: 4,475,095

[45] Date of Patent: Oct. 2, 1984

[54] ELECTROMAGNETIC SOLENOID RELAY

[75] Inventor: Samuel J. Brown, South Lyon, Mich.

[73] Assignee: Essex Group, Inc., Fort Wayne, Ind.

[21] Appl. No.: 436,141

[22] Filed: Oct. 22, 1982

[51] Int. Cl.[3] ..... H01H 51/06; H01H 1/12

[52] U.S. Cl. ..... 335/196; 335/131; 335/203

[58] Field of Search ..... 335/203, 131, 133, 196, 335/262, 193

[56] References Cited

U.S. PATENT DOCUMENTS

| | | | |
|---|---|---|---|
| 3,396,354 | 8/1968 | Fisher | 335/262 |
| 3,813,621 | 5/1974 | Blum | 335/193 |
| 4,063,204 | 12/1977 | McFarlin | 335/193 |
| 4,356,466 | 10/1982 | Brown et al. | 335/203 |

*Primary Examiner*—George H. Miller, Jr.

*Assistant Examiner*—George Andrews

*Attorney, Agent, or Firm*—Stephen A. Schneeberger

[57] ABSTRACT

A relay with plunger-type armature includes a resilient contact support, such as a conductive leaf spring, supported by a terminal in a manner affording substantial attenuation of contact bounce when engaged by an armature-mounted contact. Provision is made for insuring separation of the contacts upon reverse displacement of the armature. Specifically, a leaf spring may be fixed at one end to the base of a channel formed in the surface of a terminal plate. An overlying apertured insulator preflexes the spring and limits its displacement in the reverse direction. In a double-throw relay, the other "stationary" contact may be mounted on a resilient support, such as another leaf spring, for providing contact bounce suppression there as well.

10 Claims, 6 Drawing Figures

FIG. 2
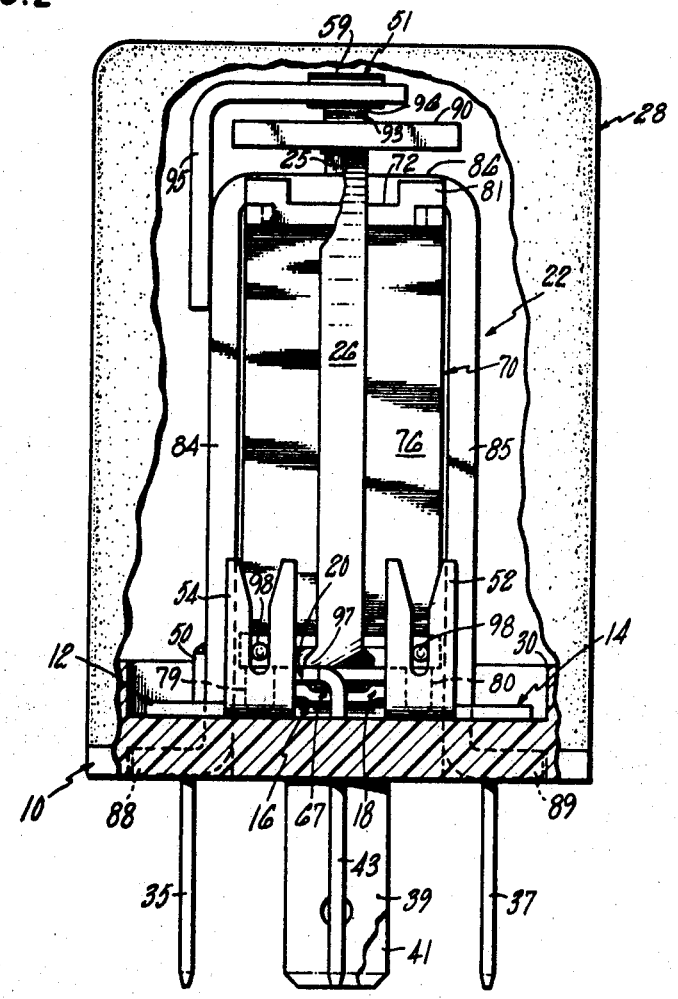
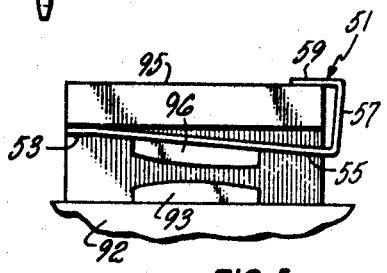
FIG. 5
FIG. 4
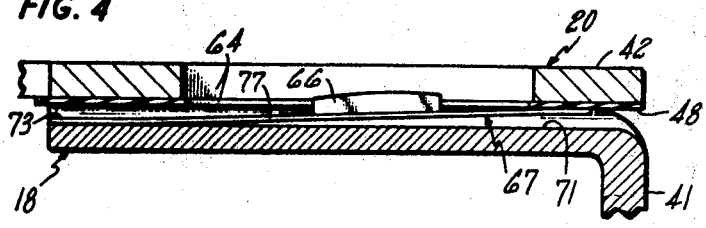

ELECTROMAGNETIC SOLENOID RELAY

DESCRIPTION

1. Technical Field

This invention relates in general to electromagnetic solenoid relays and in particular to relays of the type in which one or more electrical contacts is carried by a plunger armature.

2. Background Art

Solenoid relay constructions employing a plunger armature for moving an electrical contact into and out of engagement with another contact are well known, as exemplified by Hayden U.S. Pat. Nos. 4,003,011 and 4,064,770, Brown et al U.S. Pat. No. 4,044,322, and Brown et al allowed patent application Ser. No. 265,864. The relays of those patents have also employed a curved strip metal spring to bias the plunger armature to its at-rest position. Further, advantage for high current switching applications has been obtained through the well-known provision of magnetic blowout of arcs established at the relay contacts, as exemplified in the aforementioned Brown et al patent and patent application in which the relay contacts are located in a magnetic flux path extending from the relay armature to a stationary component of the relay electromagnet.

Still further, the aforementioned Brown et al U.S. patent application discloses a solenoid relay which includes a mechanism associated with the contact moving with the armature for damping bounce as that contact engages the stationary contact. The reduction of contact bounce is desirable to minimize superfluous circuit openings and closings and the attendant noise, as well as to extend the life of the contacts. In the aforementioned Brown et al. patent application the contact bounce supression was provided by mounting a contact on a leaf spring which in turn moved substantially in unison with the armature plunger. However, a shortcoming to such arrangement exists in relatively high resistance (i.e. 85 ohms), low current relays, in which the plunger displacement is very small (i.e. 0.020 in., 0.5 mm). The contacts may become tack welded slightly, and the limited displacement of the armature and bounce suppression spring is insufficient to separate the contacts.

Accordingly, it is the general object of the present invention to provide an improved solenoid relay of the type employing a plunger-type armature, especially in which the armature displacement is relatively restricted. As part of this object, it is desired to provide improved contact bounce suppression. A further object of the invention is the provision of such improved contact bounce suppression in a relay employing a curved spring for biasing the armature to its at-rest position and which utilized the magnetic blowout effect to provide increase current interrupting capacity. A still further object of the invention is the provision of such improved relay which is also compact in size and of a low manufacturing cost.

In accordance with the present invention, there is provided in a relay having a plunger-type armature, a resilient contact support, such as a leaf spring, which is supported by a terminal in a manner which affords substantial attenuation or elimination of contact bounce yet insures separation of the contacts upon reverse displacement of the armature. The contact is mounted on the resilient support for opposed, yielding engagement with a contact carried by the armature plunger. A clamp, such as an insulator, is positioned to limit displacement of the resilient contact support during reverse displacement of the armature, thereby insuring contact separation. The yieldable contact support is structured to decelerate the armature and its contact in a manner which results in cessation of contact bouncing substantially instantaneously, being less than about 50 microseconds.

Specifically, the plate-portion of a terminal extends parallel to the base of the relay and includes a channel therein in which a leaf spring is disposed. One end of the leaf spring is anchored to the terminal and the other end is bent outwardly to extend above the channel. An apertured insulator is interposed between the terminal plate and the bobbin of the electromagnet for clamping or limiting the spring to displacement within the terminal plate channel. A contact is conductively bonded to the leaf spring at a position thereon in register with the insulator aperture for engagement by the armature contact. The relay is preferably of the type which employs a long, arcuate leaf spring for biasing the armature to its at-rest position. Moreover, the bounce-suppressed contact is positioned within the relay's magnetic field to obtain magnetic blowout.

In a double-throw relay, the other "stationary" contact may also be mounted on a resilient support for providing bounce suppression there, as well. That resilient contact support preferably also includes provision for limiting the extent to which the contact support can follow the armature in its withdrawal therefrom to thereby insure contact separation.

BRIEF DESCRIPTION OF DRAWINGS

FIG. 2 is a sectional view taken substantially along line 2—2 of FIG. 1;

FIG. 4 is an enlarged view of a portion of the relay of FIG. 1 showing the lower armature bounce suppressor in greater detail;

FIG. 5 is an enlarged view of a portion of the relay of FIG. 1 with the armature actuated and showing the upper armature bounce suppressor in greater detail.

BEST MODE FOR CARRYING OUT THE INVENTION

Figure 1:
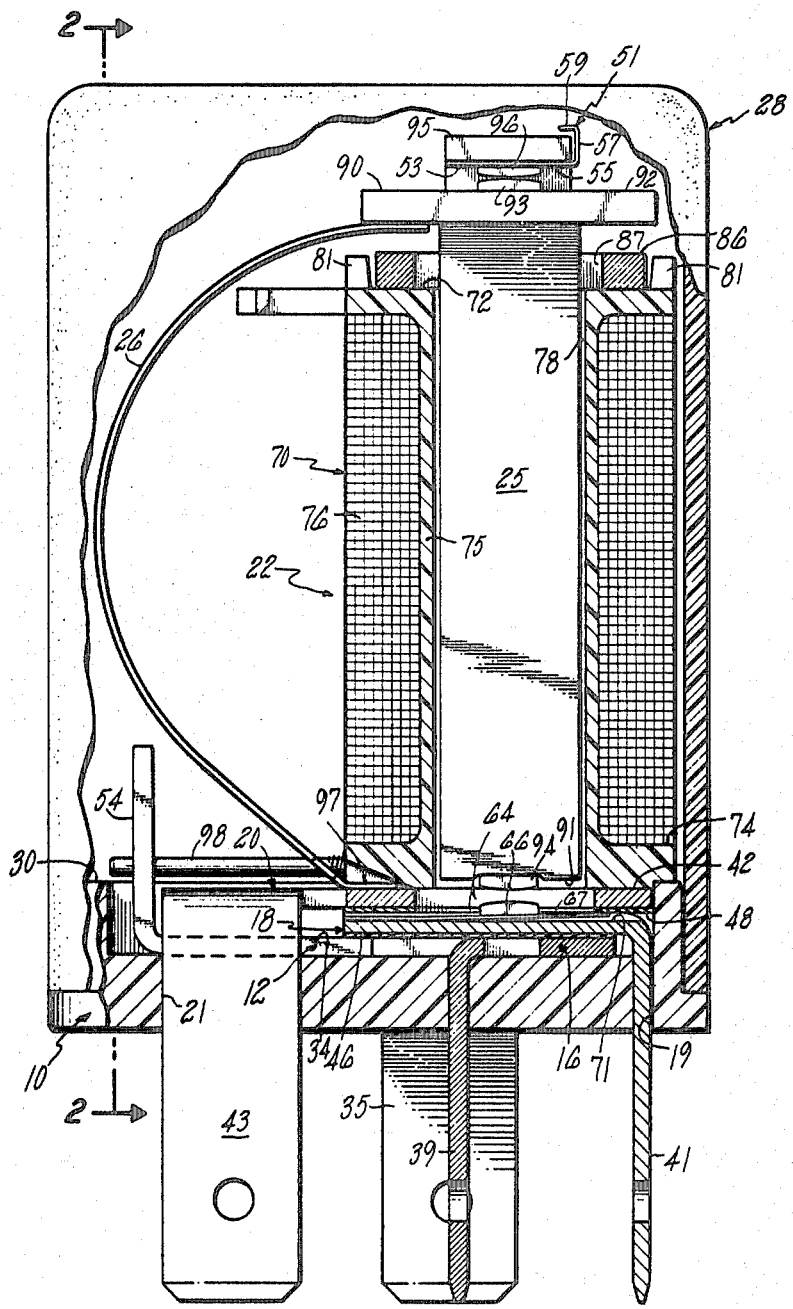
FIG. 1 is a side elevation, partly in section and with portions broken away, of an electromagnetic solenoid relay according to one embodiment of the present invention.

Referring now to the drawings, and particularly FIGS. 1–6, a solenoid relay in accordance with a first embodiment of the present invention includes a base 10, five terminals 12, 14, 16, 18 and 20 assembled, several in stack form, on the base 10, and an electromagnet 22 mounted on the base 10. A plunger armature 24 is slidably supported in the electromagnet 22 and is biased to an at-rest position shown in FIG. 1 by a resilient spring 26. A cover 28 may be provided to fit over the relay for protection against dirt and other foreign material.

The base 10 is generally square in shape, is relatively small, being about 2.6 cm on a side and may be molded as a single element from a suitable insulation material such as nylon resin. The base 10 has an upper planar supporting surface 29 surrounded by an upstanding rim 30. A number of generally rectangular slots extend most, but not all, of the way downwardly through the base 10 from its planar surface 29. A thin protective layer of the material of base 10, as for instance 0.1–0.2 mm thick provides the base at the lower end of each slot to prevent introduction of foreign material to the relay. The patterning of the slots is such as to include all major termination patterns. Various elements of the relay, including terminals 12, 14, 16, 18 and 20 and the electromagnet 22 include members which are installed through the base 10 by punching through the thin base in the respective slots. More specifically, in the illustrated embodiment of a single-pole, double-throw relay having a DIN termination pattern, five of the slots 13, 15, 17, 19 and 21 are sized and positioned to receive terminals 12, 14, 16, 18 and 20 respectively. Further, a pair of generally square slots 31 are also provided to receive a portion of the electromagnet 22. The base 10 may also have two projections 32 at its ends which are shaped to seat in corresponding openings 33 in the cover 28.

The terminals 12, 14, 16, 18 and 20 are formed from a ferromagnetic material and are mounted upon the base 10 in stack form to provide a compact relay in accordance with an aspect of the invention. These terminals 12, 14, 16, 18 and 20 are each integral stampings of a generally inverted L-shaped configuration and have respective plate portions 34, 36, 38, 40 and 42 overlying the supporting surface 29 of the base 10 and respective integral blade portions 35, 37, 39, 41 and 43 by which electrical connections may be made. The blade portions 35, 37, 39, 41 and 43 are suitably disposed to extend through the slots 13, 15, 17, 19 and 21 respectively of the base 10, with blade portions 35 and 37 having barbs to resist removal. The plate portions 34, 36 and 38 of terminals 12, 14 16 respectively are sized and configured such that they may be positioned in substantially the same plane, adjacent to but spaced from one another on the surface 29 of base member 10. The terminal plate portions 40 and 42 are then assembled in stack form on the lowermost terminal plate 38 with a thin sheet (0.005 in., 0.12 mm) insulator 46 of a suitable material, such as the synthetic product Mylar or the like, interposed between the plate 40 and the plate 38 therebelow and another thin sheet insulator 48 of like material interposed between the plate portions 40 and 42. The terminals 12 and 14 typically are laterally outside the aforementioned stack of terminals and insulators. The plate portion 38 of the terminal 16 carries an upwardly extending tab 50 for welded connection with part of the electromagnet 22. The plate portions 34, 36 have respective upwardly extending lead pin connecting posts 52, 54. To assure accurate location of the terminals 16, 18, 20 relative to the base 10, each of the plate portions 38, 40, 42 and the insulators 46 and 48 has a pair of holes therethrough or semicircular notches in the sides thereof numbered 56, 58. The plate portion 38 of terminal 16 further includes a pair of notches 60, 62 along its edge portions, each notch matching a portion of a respective one of the pair of slots 31 in the base 10. In addition, the plate portion 42 of terminal 20 and the insulator 48 are each provided with a central aperture 64 therethrough in alignment with a contact 66 on terminal 18 to be described hereinafter in greater detail.

The electromagnet 22 comprises a generally U-shaped (inverted) bracket 68 of ferromagnetic material and a bobbin 70 which may be molded from a suitable insulation material such as a glassfilled nylon resin. The bobbin 70 includes two end flanges 72, 74 and a central tubular portion 75 about which an electrically energizeable coil 76 is wound between the flanges 72, 74. The bobbin 70 has a bore 78 of generally rectangular crossection extending axially through the tubular portion 75 and the end flanges 72, 74. The lower flange 74 is provided with a pair of downwardly extending cylindrical lugs 79, 80 which project respectively through the aligned pairs of holes and notches 56, 58 of the plate portions 38, 40 and 42 and the insulators 46 and 48. The length of the lugs 79, 80 relative to the stacked thickness of plates 38, 40, 42 and insulators 46, 48 is such that the lower ends of the lugs terminate within the thickness of lowermost plate 38. These lugs 79, 80 are accurately located relative to the bobbin bore 78 to position the bore 78 in alignment with the apertures 64 of the plate portion 42 and insulator 48. The upper flange 72 is provided with a recessed channel provided by upstanding corner posts 81 for positioning of the bracket 68 relative to the bobbin 70. Additionally, the upper flange 72 includes a pair of spaced-apart support members 82 extending laterally from one end of the flange for supportedly engaging an associated circuitry package (not shown).

The bracket 68 comprises a pair of parallel leg portions 84, 85 joined by a bight portion 86 which overlies the bobbin end flange 72 and has an opening 87 therethrough in alignment with the bore 78 of the bobbin 70. The leg portions 84, 85 of the bracket 68 are located closely adjacent the edges of the bobbin end flanges 72, 74 and the bight portion 86 is snugly received in the channel formed by corner posts 81 of the end flange 72 to accurately position the bobbin 70 relative to the bracket 68. At the respective free ends of the leg portions 84, 85, the bracket 68 has two downwardly extending stud portions 88, 89. These stud portions 88, 89 project respectively, through the notches 60, 62 of the plate portion 38 and thence through the innermost portions of the pair of slots 31 where they are staked over in an outward direction against the lower surface of the base 10. The free ends of the leg portions 84, 85 are in engagement with the plate portion 38 of the terminal 16 and the bottom bobbin flange 74 engages the plate 42 of terminal 20 so as to maintain the stack form assembly of the terminals 16, 18, 20 and the insulators 46, 48 securely positioned between the base 10 and the bracket 68 and bobbin 70. Additionally, the bobbin 70 is retained in position between the plate portion 42 of the terminal 20 and the bight portion 86 of the bracket 68.

The armature 24 includes a square prismatic plunger body 25 and, in accordance with an aspect of the invention, a head flange 92, of ferromagnetic material. The plunger 25 is of rectangular cross-section and is slidably located in the bore 78 of the bobbin 70 for linear reciprocation as hereinafter described. The armature plunger 25 has four flat longitudinal sides extending between head flange 92 and a lower transverse end 91. All corners of the plunger 25 are preferably rounded slightly to insure free sliding movement of the armature in the bobbin bore 78. The armature head flange or plate 92 extends transversely of plunger 25 and defines an upper end 90 of armature 24. The head flange 92 may be an integral portion 25 of the armature 24 or it may be a separate element affixed thereto in a manner providing a low reluctance magnetic flux path therebetween, as by welding or brazing. In a preferred embodiment, the plunger 25 and head flange 92 are integral, being formed by cold heading. Upper and lower electrical contacts 93, 94 are affixed to the upper and lower ends 90, 91 of armature 24 and are formed of silver or other good nonmagnetic, electrical contact material which may be welded in place. Flange 92 is generally rectangular and of sufficient transverse extent to extend beyond the bracket bight opening 87 and over most or all of bracket bight 86, in spaced relation therewith, such that the resulting flux path is between the bracket bight and the armature head flange and the resulting magnetic force is parallel to the longitudinal extent of armature plunger 25. Additionally, the bight opening 87 is made large relative to plunger 25 to increase the transverse or radial clearance between the plunger and bight 86 and thereby minimize fringing flux. For example, plunger 25 may have a cross-section of 0.11 in. (2.7 mm) by 0.24 in. (6 mm) with bight opening 87 being 0.21 in. (5.2 mm) by 0.31 in. (7.7 mm). It will thus be appreciated that a serial pair of magnetic air gaps are defined, one between head flange 92 and bracket bight 86 and the other between terminals 16, 18, 20 and the lower end of armature plunger 25 both acting parallel to the longitudinal extent of plunger 25.

Further in accordance with an aspect of the invention, the U-shaped bracket 68 includes an additional bracket 95, of inverted L shape and of electrically-conductive, nonmagnetic material, such as zinc-plated brass, extending upwardly from bracket leg 84 and across the top of bracket bight 86 in spaced relation therewith. An electrical contact 96 of suitable nonmagnetic material is positioned preferably adjacent the inner surface of bracket 95 in a manner to be hereinafter described, in facing alignment with the contact 93 on the upper end of armature 24. The L bracket 95 is affixed to the U bracket 68, as by welding, for providing a nonmagnetic, electrically conductive support for contact 96 and for establishing the atrest position of armature 24 and thus, the air gap between the lower armature end 91 and terminal 18 respectively, as will be hereinafter described.

Figure 3:
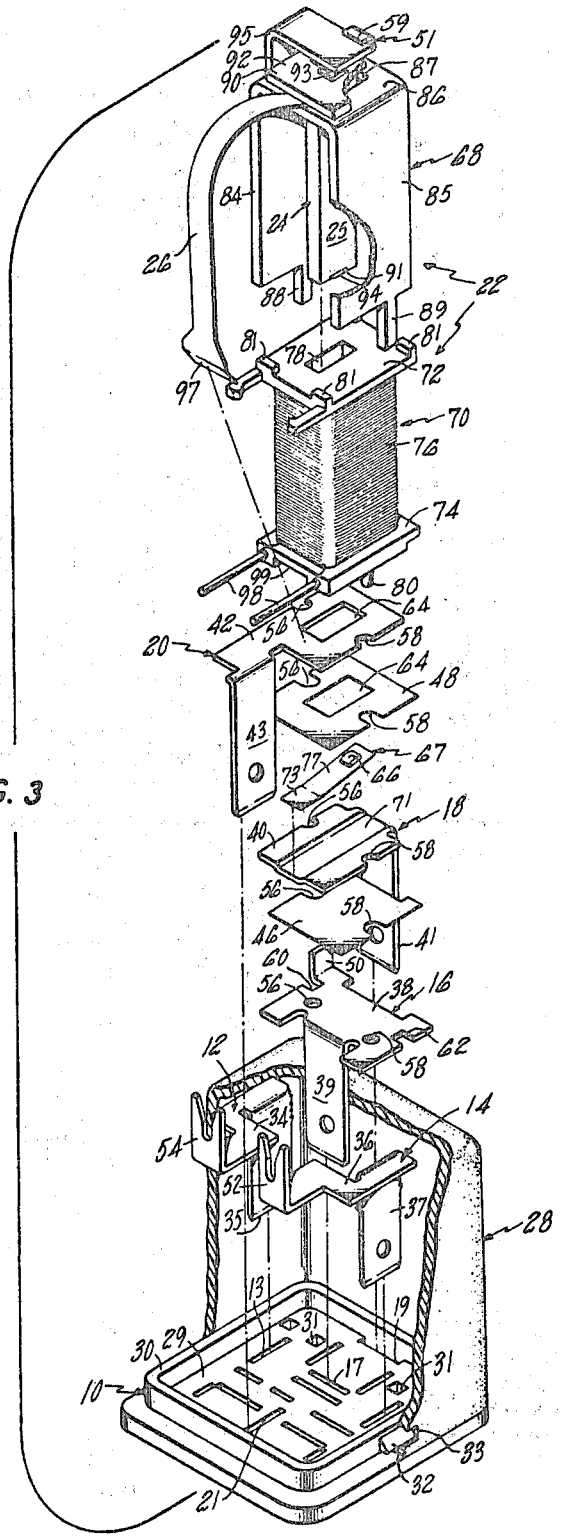
FIG. 3 is an exploded perspective view of various parts of the relay of FIGS. 1 and 2.

The resilient spring 26 is formed from a strip of spring metal having conductivity suitable to carry the relay's rated current. One such high conductivity spring material particularly applicable to the spring 26 is a silver-copper alloy marketed by the C. G. Hussey Company as its Type SSC-155 alloy. The upper end of spring 26 is affixed, as by welding, to the under surface of the armature head flange 92. As shown in FIG. 3, the lower end of spring 26 includes a base portion 97 which is somewhat enlarged and prebent for welded, conductive attachment to the upper surface of terminal plate 42. As illustrated in FIG. 1, the length of spring 26 is such that it is elastically flexed into an arcuate shape when its base portion 97 is anchored and armature 24 is installed in the aperture 78 of bobbin 70, such that the armature 24 is urged upwardly to an at-rest position with its contact 93 in engagement with the contact 96 of bracket 95. The considerable length of spring 26 minimizes the effect of any small changes in its length and/or positioning.

In accordance with another aspect of the invention, bounce suppression for armature 24 is provided by resiliently mounting contact 16 and preferably also contact 96. The electrical contact 66 associated with plate 40 of terminal 18 is mounted on a resiliently yieldable member, such as leaf spring 67, to reduce or eliminate contact bounce when armature 24 is actuated. More specifically, a shallow channel having a depth of about 0.015 in. (0.38 mm) is coined in the front or upper surface of plate 40 on terminal 18. The length, width and thickness of leaf spring 67 are slightly smaller than that of the channel 71 in terminal plate 40 to permit installation of the spring therein, but sufficient to carry the rated current. Importantly, the thickness of spring 67 is less than the depth of the channel 71 at least in that region of the spring which supports contact 66, to allow some resilient displacement of the spring relative to terminal 18 when contact 66 is impacted by contact 94 on armature 24. Specifically, the spring 67 is of a nonmagnetic, electrically-conducting material such as that of spring 26 and may have a thickness of about 0.006 in. (0.15 mm) and include a base or anchorage portion 73 and a cantilevered arm portion 77 extending from the base portion at an upward angle of about fourteen degrees therewith. Spring base 73 is affixed, as by welding, to the base of channel 71 in terminal 18 to provide good electrical contact therewith. The upward angle of spring arm portion 77 is such that its distal end extends above the surface of terminal plate 40 until, as illustrated in FIG. 4, the insulator 48 is applied thereover in the stacked assembly of the terminals. In that assembled position, the undersurface of insulator 48 is positioned against the upper surface of terminal plate 40 and the free end portion of the arm portion 77 of spring 67 is urged downward to a flexed position substantially flush with the upper surface of terminal plate 40. The positioning of contact 66 along spring 67 is such that it is then in alignment with the contact 94 on the lower end of armature 24 and also affords a relatively large downward displacement of spring 67. The apertures 64 in terminal plate 42 and in insulator 48 permit downward actuation of the armature 24 and its contact 94 into yielding engagement with contact 66. Contact 66 is capable of being resiliently displaced downward a distance of about 0.008–0.009 in. (0.20–0.23 mm) to decelerate the actuated armature 24 in a gradual manner which damps and substantially eliminates contact bounce. Such range of displacement is obtainable by positioning contact 66 relatively outboard along spring 67. Tests have revealed that it typically takes 2–3 milliseconds or longer for prior art relay contacts to cease bouncing, whereas with the aforedescribed bounce suppressor of the present invention such cessation of contact bouncing occurs substantially instantaneously, being less than about 50 microseconds. It will also be appreciated that some other arrangement might be provided for resiliently supporting the contact 66, as for instance by affixing spring 67 to a pedestal in the groove 71 or by using a spring of a different configuration, though it is normally desirable that the spring be prestressed as by insulator 48. In any event, it is necessary to provide some spacing between contacts 66, 94 when the armature 24 is in its at-rest position and insulator 48 insures that spring 67 and contact 66 are stripped from contact 94 as the armature 24 returns to its at-rest position.

Although the contact 96 supported by L bracket 95 might be rigidly affixed to the undersurface thereof, it is preferable for purposes of contact bounce suppression to also resiliently mount that contact. Accordingly, referring to FIGS. 1-3 and 5, the contact 96 is welded onto a leaf spring 51 having characteristics generally similar to the lower contact spring 67. Specifically, spring 51 includes a base portion 53 welded to the undersurface of L bracket 95 and a contact-supporting portion 55 which is prebent downwardly from base portion 53 at an angle of 10°–15° therewith and on which contact 96 is mounted. Further, spring 51 includes a limit-arm portion 57 extending upwardly from portion 55 and terminating in a catch or lip 59 which extends inwardly over an edge of L bracket 95. It will be understood that lip 59 engages bracket 95 to stop or limit the displacement of spring 51 and its contact 96 in a return direction (downward, inward). This serves to strip the armature contact 93 away from spring contact 96. The length of limit arm 57 is selected to establish a slightly prestressed positioning of spring portion 55 when the contacts 93, 96 are disengaged, which positioning is effective upon engagement of contacts 93, 96 by the action of main spring 26 to allow sufficient upward (outward) displacement of the spring 51 and the contacts to provide significant contact bounce suppression, yet also enable the spring portion 55 to contact the L bracket 95 so as to provide a positive stop to which the contacts 93, 96 and the air gap formed between the lower armature and 91 and terminal 18 are referenced in the at-rest position. Typically that air gap is about 0.017 in. (0.45 mm) and that range of displacement of spring 51 at the location of contact 96 is about 0.008–0.010 in. (0.20–0.25 mm). It will be further evident that because the armature 24 is moved upward by main spring 26 to a limit position against the underside of L bracket 95 (through the intermediates of contacts 93, 96 and spring 51) in the at-rest position, the precise dimensions of the two aforementioned magnetic air gaps are easily provided during manufacture and maintained during repeated operation. It will be understood that a portion of bracket 95 might be formed to perform the functions of limit-arm 57 and lip 59 on spring 51, thus obviating the need to place them on the spring itself.

It will be observed that the configuration of the relay components provides a compact single-pole, doublethrow relay which may be rapidly assembled in a simple manner. The terminals 12, 14, and 16 are positioned on base 10. Then insulator 46, terminal 18 with spring 67 and contact 66, and insulator 48 are stacked thereabove in succession. The base end 97 of spring 26 is welded to plate 42 of terminal 20, with the other end of the spring being welded to armature flange 92 to form a subassembly. Then the U bracket is placed over the bobbin 70, the armature plunger 25 is inserted through the bracket bight opening 87 into the bobbin bore 78, and the terminal 20 is moved into position on the terminal stack, thus arcuately flexing spring 26. The U bracket 68 and bobbin 70 are then moved down, with bracket studs 88, 89 punching through slots 31 in base 10 and the bobbin base flange 74 engaging terminal plate 42. A small relief channel 99 is provided in the underside of bobbin base flange 74 to afford unimpeded movement of main spring 26. The stud portions 88, 89 of bracket 68 are then staked over, beneath base 10, to secure the stationary parts in fixed relation. The tab 50 of terminal 16 and the L bracket 95 with spring 51 attached are then each welded to U bracket 68 at their respective positions. The end leads of coil 76 are wound about and soldered to a respective pair of lead pins and those pins are inserted into and soldered or welded to posts 52, 54. Finally, the cover 28 is placed over the relay assembly with the projections 32 on base 10 being received in cover openings 33.

In operation of the relay, the terminals 12 and 14 are connected through a control circuit to the respective poles of a battery for controlling energization of the coil 76. Terminal 20 provides the common terminal connected through spring 26 to armature 24 and its associated contacts 93, 94. The terminal 16 is electrically connected to the normally-closed contact 96, and the terminal 18 is electrically connected to the normally-open contact 66. Upon energization of the coil 76, a magnetic flux path is established across the gap between armature flange 92 and bracket bight 86 and across the gap between the lower armature end 91 and the plate 42 of terminal 20, thereby resulting in attractive magnetic forces at those gaps which act parallel to the armature plunger 25 to cause its actuation. The resistance of coil 76 is relatively high, being about 85 ohms, such that the resulting current, and thus magnetic field, is small and reliance is placed on the additive forces across the two aforementioned gaps to provide the requisite armature pull-in forces. Bounce suppressor spring 67 minimizes or eliminates any bounce between contacts 94, 66. When coil 76 is deenergized, the magnetic field collapses, and spring 26 acts to return armature 24 to its at-rest position. The bounce suppressor spring 67 moves relatively upward or outward until stopped or limited by insulator 48, whereupon the armature contact 94 is stripped from the terminal contact 66. The armature 24 continues its outward movement until it is slowed and stopped by bounce suppressor spring 51 adjacent L bracket 95.

Figure 6:
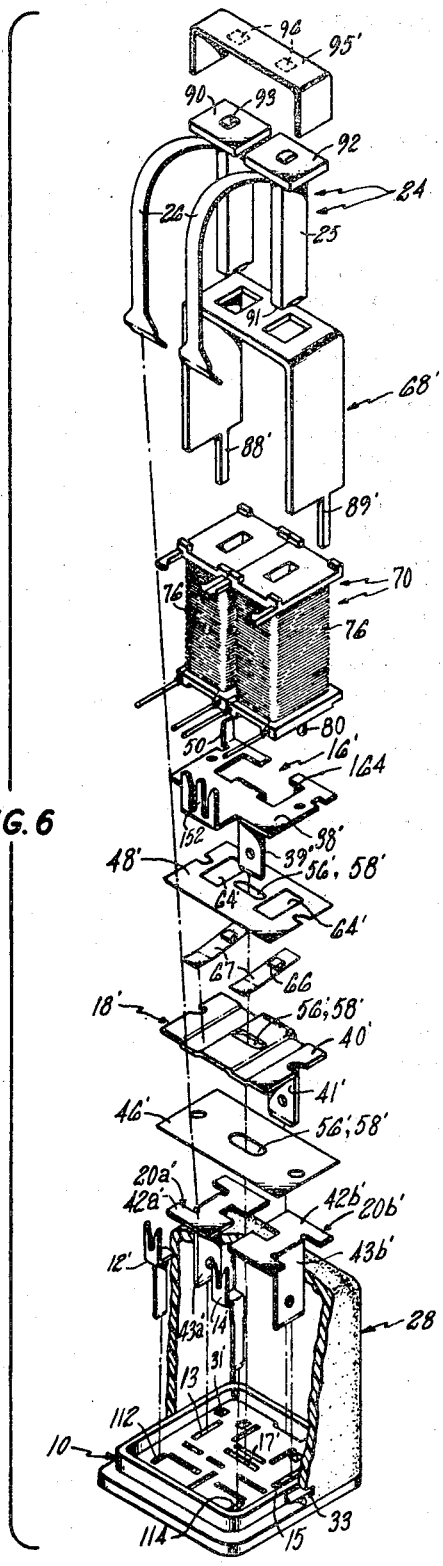
FIG. 6 is an exploded perspective view of an electromagnetic solenoid relay according to another embodiment of the present invention.

In accordance with an aspect of the invention, the stacking of the terminals permits a double-pole, doublethrow relay, having dynamic braking capability, to be provided on the same base 10 and within the same cover 28, utilizing pairs of several standardized components including the armatures 24, springs 26 and bobbins and coils 70, 76 previously described. Referring to FIG. 6, such a double-pole, double-throw relay is depicted in exploded form. Those components which are identical to components described with reference to the single-pole, doublethrow relay of FIGS. 1–5 are identified with the same reference numerals in FIG. 6 and will not require further description.

Components of the FIG. 6 double-pole, doublethrow relay which are functionally and structurally similar to components in the FIG. 1–5 relay, but which accommodate both poles in a single, larger structure are identified with a primed reference numeral, and include U bracket 68' and a double L bracket 95'. The studs 88', 89' at the base of U bracket 68' extend through slots 31' in base 10 and are staked over. The double-L bracket 95' is joined at its midpoint such that it has the appearance of an inverted U.

Other components of the FIG. 6 relay embodiment have also been identified by primed reference numerals because of their similarity to FIG. 1 counterparts, but require some further discussion. For instance, the terminals 12' and 14' are somewhat smaller than their FIG. 1 counterparts and are each connected to an end of a separate coil 76, rather than to opposite ends of the same coil. Terminals 12' and 14' have barbed blade portions which extend through slots 112 and 114 of base 10.

Further, the terminal 16' includes a blade portion 39' insertable through a slot 17' in the base 10. Terminal 16' is arranged uppermost in the stack of terminals 16', 18' and 20' in this embodiment and thus is provided with an enlarged cutout portion 164 in its plate portion 38' to permit passage of the armatures 24. Terminal 16' includes a tab 50 for attachment to the U frame 68'. Terminal 16' also includes a connecting post 152 extending upwardly from plate portion 38' with a pair of notches therein for each receiving the pin connected to the remaining end of a respective one of each of the coils 76, and thus is electrically common to both coils and also to both contacts 96 on bracket 95'.

The upper and lower discrete insulators 48' and 46' respectively, and the terminal 18' each are provided with a transverse slot 56', 58' extending therethrough for receiving not only the lugs 79, 80 on the bobbins 70, but also to pass the blade portion 39' of terminal 16'. That slot 56', 58' in terminal 18' is sized to avoid electrical contact with terminal blade portion 39'. The terminal 18' also mounts two contacts 66 on respective springs 67 such that they are electrically common to one another. A pair of apertures 64' in insulator 48' permit passage of respective armatures 24.

A pair of electrically separate terminals 20a', 20b' each include a respective blade portion 43a', 43b' which extends through respective slots 13, 15 in base 10. The terminals 20a', 20b' also include respective integral plate portions 42a', 42b' and are so structured and positioned that they do not contact or provide an electrical path between one another, nor do they contact blade portion 39' of terminal 16'. Terminals 20a' and 20b' are geometrically identical and positioned in "mirror image" relation to one another such that only one shape is required. A respective main spring 26 is conductively affixed to each terminal 20a', 20b' as previously described. Terminals 20a', 20b' are adjacent the base 10 in the terminal stack of this embodiment.

In various relay applications involving the control of an inductive motor, as in raising and lowering the windows in an automobile, it is necessary to provide dynamic braking of the motor. This is done by maintaining the motor armature shorted, except when the "up" or the "down" relay coil is energized. As is known, such mode of motor control is most conveniently provided by a double-pole, double-throw relay, and the aforedescribed relay embodiment of FIG. 6 provides a particularly compact relay for such purpose.

Specifically, each blade portion 43a', 43b' of the respective terminals 20a', 20b' is electrically connected to a respective opposite end of the motor armature (not shown). Each terminal 20a', 20b' is electrically connected, through respective springs 26, to respective relay armatures 24 and thus the contacts 94, 93 on the opposite ends thereof. The contacts 96 are electrically connected to terminal 16' which may in turn be connected to an external source of one electrical potential. The contacts 66 similarly are electrically connected to terminal 18' which may in turn be connected to an external source of another electrical potential. It will be appreciated that when both relay armatures 24 are in their at-rest positions, a short circuit is created across the motor armature to effect dynamic braking. When one armature 24 (i.e. "up" or "down") is actuated the other (i.e. "down" or "up") normally is not actuated, such that the relative polarities of the external potential applied across the motor armature (and thus the direction of current flow therethrough) are in one direction or the other to effect motor operation in one direction or the other.

Although this invention has been shown and described with respect to detailed embodiments thereof, it will be understood by those skilled in the art that various changes in form and detail thereof may be made without departing from the spirit and scope of the claimed invention.

Having thus described a typical embodiment of my invention, that which I claim as new and desire to secure by Letters Patent of the United States is:

1. An electromagnetic solenoid relay of the type comprising:
- a base of insulation material;
- a coil bobbin mounted on said base and having a bore extending axially therethrough;
- an electrically energizeable coil wound on said bobbin;
- a plunger armature guided in the bore of said bobbin for endwise reciprocatory motion between an at-rest position and an actuated position upon the energization and de-energization of said coil;
- a first contact secured to an end of said armature;
- ferromagnetic circuit means embracing said coil bobbin for attraction of said armature to its actuated position in response to the energization of said coil;
- electrical terminal means;
- a second contact supported at least indirectly by said terminal means for engagement by said first contact upon movement of said armature to one of its said at-rest and actuated positions; and
- a resilient first spring for urging said armature to its at-rest position, said electromagnetic solenoid relay being further characterized by the following:
  - electrically conductive second spring means, said second contact being electrically connected with and resiliently supported by said second spring means to thereby damp contact bounce, said second spring means being electrically connected with said terminal means; and
  - stop means positioned for coactive engagement with said second spring means to thereby limit displacement of said second spring means and accordingly, said second contact, in the direction in which said armature and first contact retreat therefrom, thereby to insure separation of said first and said second contacts.

2. The relay of claim 1 wherein said second spring means comprises a leaf spring and said stop means comprises an insulator.

3. The relay of claim 2 wherein said leaf spring is mounted in cantilevered fashion.

4. The relay of claim 3 wherein said leaf spring is preflexed by said coactive engagement with said stop means.

5. The relay of claim 1 wherein said terminal means include plural terminals, said second contact being supported by one said terminal and further including:
- a third contact secured to the other end of said armature;
- a fourth contact supported at least indirectly by an other of said plural terminals for engagement by said third contact upon movement of said armature to the other of its said at-rest and actuated positions;
- electrically conductive third spring means, said fourth contact being electrically connected with and resiliently supported by said third spring means to thereby damp contact bounce;
- said third spring means being electrically connected with said other of said plural terminals; and
- other stop means positioned for coactive engagement with said third spring means to thereby limit displacement of said third spring means and accordingly, said fourth contact, in the direction in which said armature and said third contact retreat therefrom, thereby to insure separation of said third and fourth contacts.

6. The relay of claim 5 wherein said second and said third spring means are each leaf springs mounted in cantilevered fashion, said stop means comprises a sheet-like insulator and said other stop means includes a portion of a support bracket, said third spring means being mounted on said support bracket.

7. An electromagnetic solenoid relay of the type comprising:

a base of insulation material having a generally planar supporting surface;

a coil bobbin mounted on said base and having a bore extending axially therethrough;

an electrically energizeable coil wound on said bobbin;

a plunger armature guided in the bore of said bobbin for endwise reciprocatory motion between an at-rest position and an actuated position upon the energization and de-energization of said coil;

a substantially U-shaped ferromagnetic bracket embracing said coil bobbin and secured to said base, said bracket having a pair of parallel leg portions extending from said base alongside said bobbin and joined by a bight portion overlying one end of said bobbin, said bight portion having an opening therethrough in alignment with the bore of said bobbin through which an outer portion of said plunger projects;

a first contact secured to the end of the inner portion of said armature;

an electrical terminal of a ferromagnetic material mounted on said base intermediate the free ends of said leg portions of said bracket beneath the other end of said bobbin for attraction of said armature to its actuated position in response to the energization of said coil;

a second contact mounted on said terminal for engagement by said first contact upon movement of said armature to its actuated position; and a resilient spring for urging said armature to its at-rest position, said spring comprising a continuous length of spring strip metal and having an arcuate portion extending between one end secured to said outer portion of said armature and an opposite end fixed realtive to said base;

said electromagnetic solenoid relay being further characterized by the following:

said terminal including a plate portion extending generally parallel with said supporting surface of said base and having a front surface facing said bobbin; said plate portion being coined to define a longitudinally extending shallow channel in said front surface;

a conductive metal leaf spring disposed in said channel and having a thickness less than the depth of said channel; said leaf spring having an anchorage end portion fixed to said plate portion adjacent one end of said channel and having a flexible free arm portion extending lengthwise in said channel; said arm portion being initially out-turned obliquely with respect to said anchorage portion so as to have its free end portion raised out of said channel;

stop means interposed between said bobbin and said plate portion including an insulator holding the free end portion of said arm portion within said channel in spaced relation to the bottom of said channel and thereby flexing said arm portion;

said second contact being mounted on said arm portion; and a part of said arm portion being further deflectable into said channel whereby said arm portion is further flexed after initial engagement of said first contact with said second contact thereby damping contact bounce.

8. The relay of claim 7 wherein any contact bounce resulting from engagement between said first and said second contacts is fully damped in less than 50 microseconds.

9. The relay of claim 8 wherein the depth of said channel in said terminal plate portion is about 0.4 mm, the thickness of said leaf spring is about 0.15 mm and said second contact is positioned relatively outward along said leaf spring arm portion to allow about 0.2 mm displacement thereof into said channel.

10. The relay of claim 8 including an other electrical terminal mounted on said base and whereby said resilient spring secured at one end to said armature is secured at its other end to said other electrical terminal in electrically conducting relation therewith.

* * * * *